United States Patent [19]

Kurihara et al.

[11] Patent Number: 4,484,519

[45] Date of Patent: Nov. 27, 1984

[54] STYLUS DRIVING APPARATUS FOR PRINTERS

[75] Inventors: Toshio Kurihara; Makoto Yasunaga; Masao Kunita, all of Tokorozawa, Japan

[73] Assignee: Citizen Watch Co. Ltd., Tokyo, Japan

[21] Appl. No.: 405,313

[22] Filed: Aug. 5, 1982

[30] Foreign Application Priority Data

Aug. 11, 1981 [JP] Japan ..... 56-125475
Nov. 10, 1981 [JP] Japan ..... 56-180160

[51] Int. Cl.[3] ..... B41J 3/12; B41J 9/38

[52] U.S. Cl. ..... 101/93.05; 101/93.48; 400/121; 400/157.2

[58] Field of Search ..... 400/121, 124, 157.2; 101/93.04, 93.05, 93.48

[56] References Cited

U.S. PATENT DOCUMENTS 3,672,482 6/1972 Brumbaugh et al. ..... 101/93.05 X
4,044,668 8/1977 Barrus et al. ..... 400/124 X
4,225,250 9/1980 Wagner et al. ..... 101/93.05 X
4,348,120 9/1982 Isobe et al. ..... 101/93.05 X
4,351,235 9/1982 Bringhurst ..... 400/121 X
4,393,771 7/1983 Tatsumi ..... 101/93.04 X

*Primary Examiner*—Paul T. Sewell
*Attorney, Agent, or Firm*—Birch, Stewart, Kolasch & Birch

[57] ABSTRACT

A stylus driving apparatus for an impact dot line printer is provided with a magnetic first yoke adjacent one side of a permanent magnet, a plurality of magnetic cores each having an exciting coil, a plurality of magnetic leaf springs disposed adjacent to a tip end of each core at a free end thereof, an armature secured to the free end of the leaf spring, and a magnetic second yoke diposed on the other side of the permanent magnet. The second yoke has a plurality of recesses. In the waiting position where the free end of the leaf spring is attracted to the tip end of the core, at least a part of the armature is surrounded by the inner wall of the recess of the second yoke.

4 Claims, 5 Drawing Figures

STYLUS DRIVING APPARATUS FOR PRINTERS

BACKGROUND OF THE INVENTION

The present invention relates to a stylus driving apparatus for printers and more particularly to an improvement of a stylus driving apparatus of an impact dot line printer.

Generally, a dot line printer has an advantage that such a printer having a wide print width enables line printing at a higher speed than a serial printer. Recently, demand for a dot line printer having high speed printing performance has increased. In order to increase the printing speed, it is necessary to reduce a printing impact period and decrease the space between print wires disposed on a printing line. Further, an impact dot line printer having very fine stylus is popular, because such a printer can form a dot matrix character having thin portions similar to a character printed by type. When the impact speed to a record member is increased, the impact force by the fine stylus becomes large which deteriorates an inked ribbon or the record member. In order to eliminate such a disadvantage, the equivalent mass of a stylus portion must be restrained to be as small as possible.

FIG.5 shows a conventional stylus driving apparatus which is disclosed by U.S. Pat. No. 3,941,051. The apparatus comprises a leaf spring 102 made of magnetic material, a base disk 103 secured to an end of the leaf spring 102, and a stylus 104 secured to the base disk 103. The leaf spring 102 is secured between a base plate 116 and a holding plate 105 by a screw 106. The base plate 116 is secured to a side of a permanent magnet 108. A yoke 107 made of magnetic material is secured to the other side of the permanent magnet 108. A core 110 made of magnetic material and having a coil 111 is secured to the yoke 107 at an end thereof. The other end of the core 110 corresponds to the other end of the leaf spring 102 having the base disk 103 and is adapted to attract the leaf spring 102 by the magnetomotive force of the permanent magnet 108 against the elastic force of the leaf spring 102. The coil 111 is connected to an electric circuit (not shown) and excited to produce a magnetic flux in the direction opposite to the direction of the magnetic flux which is produced by the magnetomotive force of the permanent magnet 108.

In operation, when the coil 111 is excited, the attracting force between the core 110 and the end portion of the leaf spring 102 is cancelled by the magnetomotive force by the excitation, the end of the leaf spring 102 moves to the right by own elastic force. Thus, the stylus 104 is impacted to an inked ribbon (not shown) to print a dot on a recording paper (not shown).

In such a structure, a spring steel having a high spring constant is necessary for the leaf spring 102 in order to reduce the printing impact period. However, in order to attract an end portion of the leaf spring 102 having a high spring constant, it is necessary to increase the areas of the attracting surface of the core 110 and of the attracted surface of the base disk 103 and to increase the magnetic flux density of that portion. Therefore, the permanent magnet 108 must have a large magnetomotive force and the yoke 107, core 110 and leaf spring 102 should be made of a material having a high permeability and should have large sectional areas for flux, respectively.

It is also desirable to make the leaf spring out of spring steel, since the spring steel has a high durability for bending moment. However, the spring steel has a low permeability. In addition, the leaf spring must be made with a small width in order to decrease the distance between stylus driving units along the printing line, which results in decrease of the sectional area. As a result, magnetic flux cannot be sufficiently applied to the attracting portion between the core 110 and the end of the leaf spring 102. Therefore, the attracting force exerted on the armature is restricted to a small value, which does not permit an increase of the spring constant of the leaf spring. Thus, the printing impact period can not be reduced.

U.S. Pat. No. 4,044,668 discloses a line printer, in which the front face of a housing surrounding a hammer mechanism is made of magnetic material, forming an additional flux path in parallel to the path defined by a leaf spring of the hammer mechanism. This additional flux path provides for increased flux density for the attracting portion, providing a greater attracting force for the armature. However, the armature is positioned in a position remote from the additional path when the armature is attracted to a magnet. Therefore, the attracting force is not made large so as to enable an increase in the spring constant of the leaf spring in order to reduce the printing impact period.

SUMMARY OF THE INVENTION

An object of the present invention is to provide a stylus driving apparatus suitable for a high speed dot line printer having print wires which are disposed at a small distance from each other in the printing direction.

Another object of the present invention is to provide a stylus driving apparatus which can reduce a printing period for increasing the printing speed.

According to the present invention, there is provided an improved stylus driving apparatus for printers of the type having a first yoke made of magnetic material, a plurality of magnetic cores secured to said first yoke, a coil around each of said cores, a permanent magnet disposed adjacent to one end of said first yoke at one side thereof, a plurality of magnetic leaf springs disposed adjacent to one end of said first yoke at base end thereof, the other end of each of said leaf springs being adjacent to a tip end of a corresponding one of said cores, a magnetic armature secured to a free end portion of each leaf spring, a stylus secured to each of said armatures, wherein the improvement comprises a magnetic second yoke disposed adjacent to said permanent magnet at the base end thereof, the other end portion of said second yoke being disposed adjacent to each of said armatures for forming a magnetic circuit passing through said first yoke, core, free end portion of leaf spring and second yoke, the other end portion of said second yoke having a wall portion surrounding at least a part of said armature at the waiting position of said armature attracted to said tip end of said core by magnetomotive force of said permanent magnet.

These and other objects and features of the present invention will become more apparent from the following description with reference to the accompanying drawings.

DESCRIPTION OF THE PREFERRED EMBODIMENTS

Figure 1:
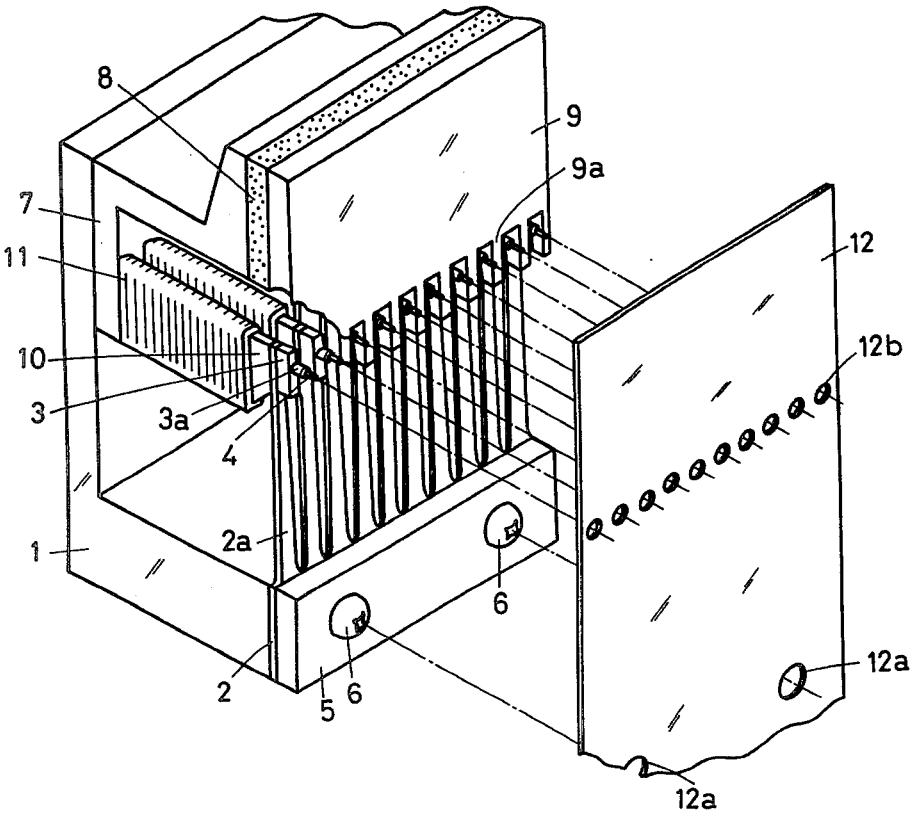
FIG. 1 is an exploded perspective view of a stylus driving apparatus according to the present invention, a part of which is broken away.

Referring to FIG. 1, a stylus driving apparatus comprises a supporting member 1 made of non-magnetic material with a small specific gravity and having an L-shaped cross-section, a comb-shaped leaf spring 2 secured to the supporting member 1 by a pair of screws 6 interposing a holding plate 5. The leaf spring 2 has a plurality of hammer spring portions 2*a*. A rectangular parallelepiped armature 3 made of magnetic material is secured to an upper end of each spring portion 2*a* and a projection 3*a* is formed on the front side of armature 3 in which a stylus 4 is securely mounted. A first yoke 7 made of magnetic material is secured to an upper portion of the supporting member 1 at a downwardly extending wall portion thereof. A permanent magnet 8 is fixed to an upwardly extending wall portion of the first yoke 7 at one attracting side of the magnet. A second yoke 9 made of magnetic material is secured to the other attracting side of the permanent magnet 8. The second yoke 9 has a plurality of downward projections 9*a* forming a plurality of recesses. An upper portion of each spring portion 2*a* and armature 3 secured to the end of the spring portion 2*a* are disposed in each recess between projections 9*a* without contacting, projecting 9*a* but closely adjacent to the projections. Accordingly, areas of the armature 3 and end portion of the spring portion 2*a* corresponding to projections 9*a* can be greatly increased and the gap between the armature 3 and the projections 9*a* can be reduced to reduce the magnetic resistance.

A plurality of cores 10 made of magnetic material and having a thin rectangular cross section are secured to the downwardly extending wall portion of the first yoke 7. The tip end of each core 10 is adjacent to the rear side of the end of the spring portion 2*a* and the rear side of the spring portion 2*a* is contacted with the tip end of the core 10 by the magnetomotive force of the permanent magnet 8 against the elastic force of the spring portion 2*a*. A coil 11 wound on each core 10 is connected to an electric circuit (not shown) and excited to produce the magnetic flux in the counter direction against the direction of the magnetic flux which is produced by the permanent magnet 8.

Figure 2:
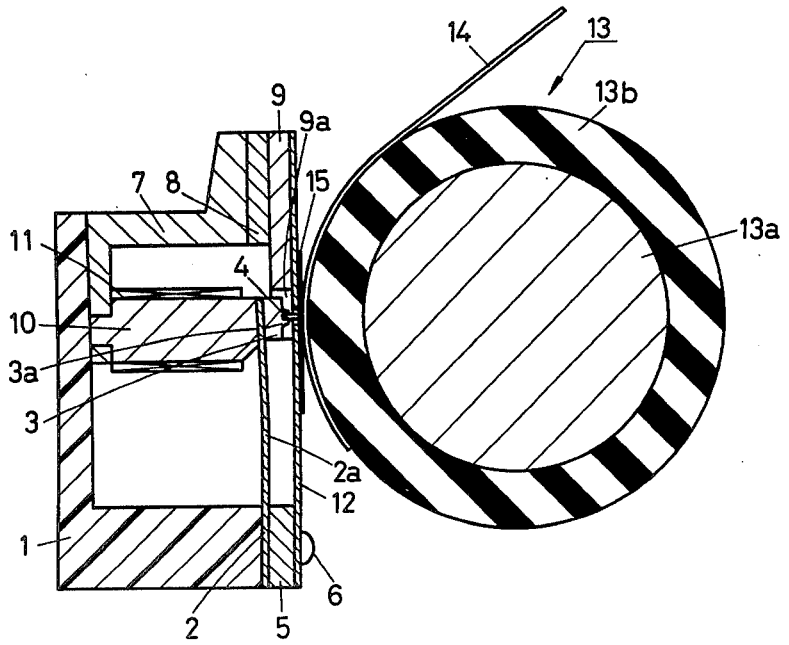
FIG. 2 is a sectional view of a dot line printer provided with the print wire driving apparatus of FIG. 1.

As shown in FIG. 2, a cover plate 12 made of magnetic material is attracted to stick to the second yoke 9 by the magnetomotive force of the magnet 8. The cover plate 12 has a pair of positioning holes 12*a* which engage with screws 6 and a plurality of holes 12*b* for styli 4 as shown in FIG. 1. The cover plate 12 is positioned by the engagement of holes 12*a* with the screws 6. The stylus driving apparatus is slidably supported on a frame (not shown) to be able to reciprocate in the lateral direction of a recording paper 14 and connected to a reciprocation driving means (not shown). A platen 13 adjacent to the stylus driving apparatus is rotatably supported in the frame and connected to a paper feeding mechanism (not shown). The cylindrical platen 13 comprises a metal core 13*a* and a peripheral rubber 13*b*. The recording paper 14 is supported on the platen 13 and adjacent to an inked ribbon 15 which is adjacent to styli 4 with a slight gap.

It will be understood that if the apparatus is so arranged that the armature 3 is directly contacted to the tip end of the core 10, magnetic flux conditions may be further improved.

The operation of the stylus driving apparatus will be described hereinafter. Referring to FIG. 2, the magnetic flux produced by the magnetomotive force of the permanent magnet 8 passes along a circuit through, in order, the first yoke 7, core 10, a gap, end portion of the spring portion 2*a* of the leaf spring 2, armature 3, gap and second yoke 9. By the flux passing the gap between the core 10 and the end of the spring portion 2*a*, the spring portion 2*a* is attracted to the core 10 against the elasticity thereof, so that the stylus 4 is held in the waiting position. It will be seen that the leaf spring 2 is fixed to the supporting member 1 which is out of the magnetic circuit, so that the magnetic circuit may be reduced in length.

When one of coils 11 is excited for a predetermined period, the attraction between the core 10 and end portion of the spring portion 2*a* is cancelled, the end of the spring portion 2*a* is driven to the platen 13 by the elastic force of the spring portion 2*a*. Thus, the stylus 4 impacts the recording paper 14 on the platen 13 through the inked ribbon 15 to print a dot on the paper. When the coil 11 is de-energized after the stylus 4 has impacted the recording paper 14, the end of the spring portion 2*a* springs back and returns to the waiting position by the attracting force exerted on the end of the spring portion 2*a*. Thus, selected stylus 4 are driven at selected positions during the reciprocation of the apparatus, while the platen 13 is rotated to feed the recording paper 14. By repeating the above described operation, the dot matrix printing may be performed.

In accordance with the printer of this invention the second yoke 9 is disposed opposite to the leaf spring 2 and the magnetic circuit is comprised of the core 10, the first yoke 7, permanent magnet 8, second yoke 9, armature 3, and an end portion of the spring portion 2*a*, without passing the entire length of the leaf spring. Therefore, the length of the magnetic circuit is shortened regardless of the length of the leaf spring. Further, the magnetic circuit may be formed by a material having a high permeability and a large section area, so that the magnetoresistance becomes lower. Thus, the attracting force between the core and the end portion of the spring portion can be increased. Since a leaf spring having a high spring constant can be employed, a high speed printer may be provided.

Figure 3:
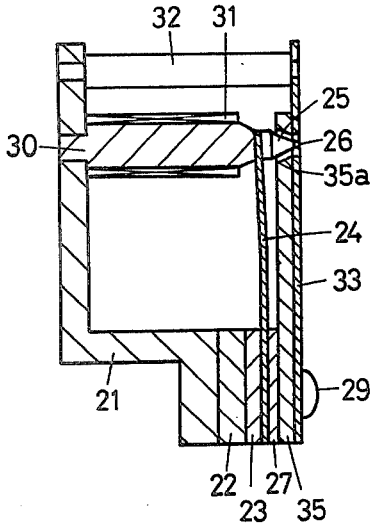
FIG. 3 is a sectional view showing a second embodiment of the present invention.

FIG. 3 shows a second embodiment. The apparatus comprises a first yoke 21 made of magnetic material, a permanent magnet 22 secured to the first yoke 21 at one attracting side thereof, and a flat supporting member 23 made of magnetic material secured to the other attracting side of the magnet and having a plurality of threaded holes. A plurality of elongated leaf springs 24 made of spring steel are disposed on the opposite side of the supporting member 23 at a predetermined distance from each other. A second yoke 35 made of magnetic material is attached to the leaf springs 24 interposing a spacer 27 made of magnetic material and further a cover 33 made of magnetic material is disposed on the second yoke 35. These members 24, 27, 35 and 33 are secured to the supporting member 23 by screws 29. An armature 25 comprising a conical body is secured to an end of the leaf spring 24. The second yoke 35 has a plurality of inner conical holes 35*a*, in each of holes 35*a* an armature 25 is situated at the waiting position. A stylus 26 is inserted into a hole provided in each armature 25 and secured thereto. The tip end of the stylus 26 is slightly projected from the corresponding hole of the second yoke 35. Thus, each armature is entirely surrounded by the wall of the conical hole 35*a* of the second yoke 33. A plurality of cylindrical cores 30 made of magnetic material are fixed to an upper portion of the first yoke 21. An end of each core 30 is adjacent to the rear side of the leaf spring 24 aligned with the armature 25 and is adapted to attract the end of the leaf spring 24 by the magnetomotive force of the permanent magnet 22 against the elastic force of the leaf spring 24. A coil 31 is wound on each core 30. Cover supports 32 of magnetic material are securely mounted on the first yoke 21 for supporting the cover 33. The projected end of the support 32 is flush with the outside surface of the second yoke 35 and the cover plate 33 is attached to the end of each support 32 and the second yoke 35.

Other structure with respect to the platen and reciprocating mechanism is the same as the first embodiment.

In this embodiment, one of the magnetic circuits of flux produced by the magnetomotive force of the permanent magnet 22 passes in order through the first yoke 21, core 30, a gap, leaf spring 24, and supporting member 23, and the other magnetic circuit is passes in order through the first yoke 21, core 30, a gap, end of the leaf spring 24, armature 25, another gap, second yoke 35, spacer 27, fixed portion of the leaf spring 24 and supporting member 23.

In the waiting state, the end of the leaf spring 24 is attracted to the tip end of the core 30 as shown in FIG. 3. The impact of the stylus to the recording paper is carried out by de-energizing the coil 31 similarly to the first embodiment. In accordance with the apparatus of FIG. 3, since the inner wall of the conical hole 35*a* of the second yoke 35 surrounds the armature 25 with a small gap therebetween in the waiting position and effective areas of opposite surfaces of the inner wall and of the armature are increased compared with conventional apparatus, magnetic flux density in the gap is high and hence the attracting force exerted on the end portion of the leaf spring 24 becomes large. Thus, a leaf spring having a high spring constant and an armature having a small mass can be used thereby to increase the printing speed. Further it is possible to print a dot matrix with a fine wire at a high speed without injuring the inked ribbon and recording member, since the mass of the armature is small and hence the kinetic energy thereof is small at impact.

Figure 4:
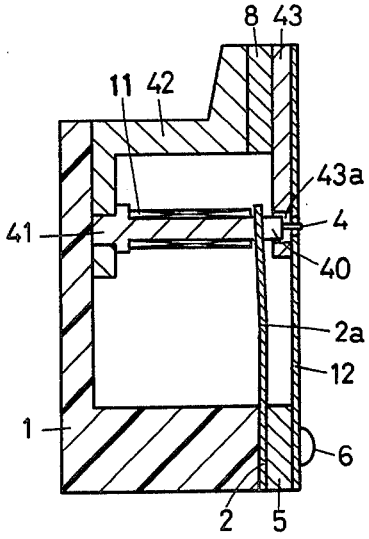
FIG. 4 is a sectional view showing a third embodiment of the present invention.
Figure 5:
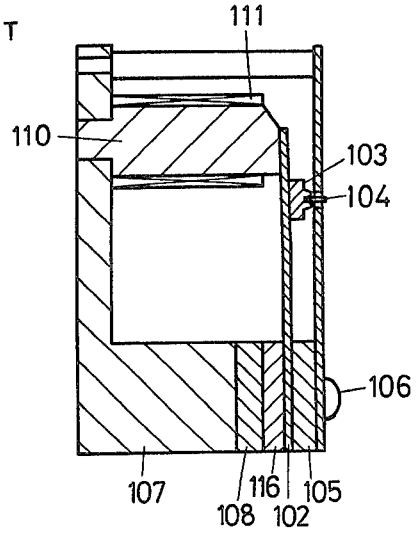
FIG.5 PRIOR ART
FIG. 5 is a sectional view showing a conventional stylus driving apparatus.

FIG. 4 shows a third embodiment of the present invention, construction of which is similar to the first embodiment. The apparatus comprises a cylindrical armature 40, a cylindrical core 41, a first yoke 42 and a second yoke 43. The second yoke 43 has a plurality of holes 43*a* adjacent to the periphery of the armature 40.

Other parts are the same as the first embodiment and the same parts thereof are identified with the same references as FIGS. 1 and 2. Alternatively, armatures 40 and holes 43*a* may also have conical configurations as described with reference to FIG. 3.

When the leaf spring portion 2*a* is attracted to the core 41, the armature 40 remains inside of the hole 43*a* with its surface closely adjacent to the inner wall thereof of the hole 43*a*. Accordingly, the magnetic flux density in the gap is increased, so that the spring constant of the leaf spring 2 may be increased. Thus, the printing speed can be increased.

We claim:

1. An improved stylus driving apparatus for printers comprising:

a supporting member made of non-magnetic material;

a first yoke made of magnetic material secured at one end thereof to a first end portion of said supporting member;

a plurality of magnetic cores, each core secured at one end thereof to said first yoke;

a coil around each of said cores;

a permanent magnet disposed adjacent to the other end of said first yoke;

a plurality of leaf springs of magnetic material secured to another end portion of said supporting member at a base portion thereof, each of said leaf springs extending in a first direction toward said core and each said leaf spring having a rear surface of an end-most portion thereof positioned adjacent to another end of a corresponding one of said cores;

an armature of magnetic material secured to the front surface of said end-most portion of each leaf spring at a position in alignment with said rear surface and said corresponding core;

a stylus secured to each of said armatures;

a second yoke of magnetic material secured at one end thereof to said permanent magnet at a side of said magnet opposite said first yoke, said second yoke extending in a direction opposite to said first direction of said leaf springs and the other end portion of said second yoke being adjacent to each of said armatures, said other end portion of said second yoke having a wall portion surrounding at least a part of each said armature in a position of said armature wherein said armature is attracted to said other end of said core by magnetomotive force of said permanent magnet for forming a magnetic circuit passing through said first yoke, through said core, between said rear and front surfaces of said end-most portion of said leaf spring where said armature is secured, through said armature and said second yoke.

2. A stylus driving apparatus for printers according to claim 1, wherein said wall portion of said second yoke is an inside wall of a recess formed in said second yoke.

3. A stylus driving apparatus for printers according to claim 1, wherein said wall portion of said second yoke is an inside wall of a hole formed in said second yoke and said armature is a cylindrical body corresponding to said hole.

4. A stylus driving apparatus for printers according to claim 1, wherein said wall portion of said second yoke is an inside wall of a conical hole formed in said second yoke and said armature comprises a conical body corresponding to said conical hole.

* * * * *